United States Patent [19]

Douglas

[11] Patent Number: 4,955,936

[45] Date of Patent: Sep. 11, 1990

[54] SCREW DRIVER TIP

[76] Inventor: Harley W. Douglas, 4 Brickwood Boulevard, Ingersoll, Ontario, Canada, N5C 3S1

[21] Appl. No.: 394,451

[22] Filed: Aug. 16, 1989

[51] Int. Cl.[5] ..... B25B 23/00

[52] U.S. Cl. ..... 81/441

[58] Field of Search ..... 81/441, 460, 461, 436; 411/403

[56] References Cited

U.S. PATENT DOCUMENTS

| | | | |
|---|---|---|---|
| 1,547,944 | 7/1925 | Murphree | 81/441 X |
| 2,258,326 | 10/1941 | Holt | 81/460 X |
| 2,815,054 | 12/1957 | Cummaro | 81/441 |

*Primary Examiner*—Meislin D. S.

*Attorney, Agent, or Firm*—Arne I. Fors

[57] ABSTRACT

A unique screw driver tip for screws having recessed sockest of the Robinson type are specifically disclosed. The driver tip has a recessed face which defines between the face and the side walls of the tip cutting margins which act as a scraping devices as the tip is in inserted into the socket to thereby scrape the side walls of the socket clean. This allows proper mating penetration of the tip into the socket and hence mating of the tip with the socket whereby the driver may then be turned and the screw rotated so that the screw may be easily removed. The profile features of the tip allow cleaning of the socket and fip penetration into the socket by one single and continuous motion.

1 Claim, 1 Drawing Sheet

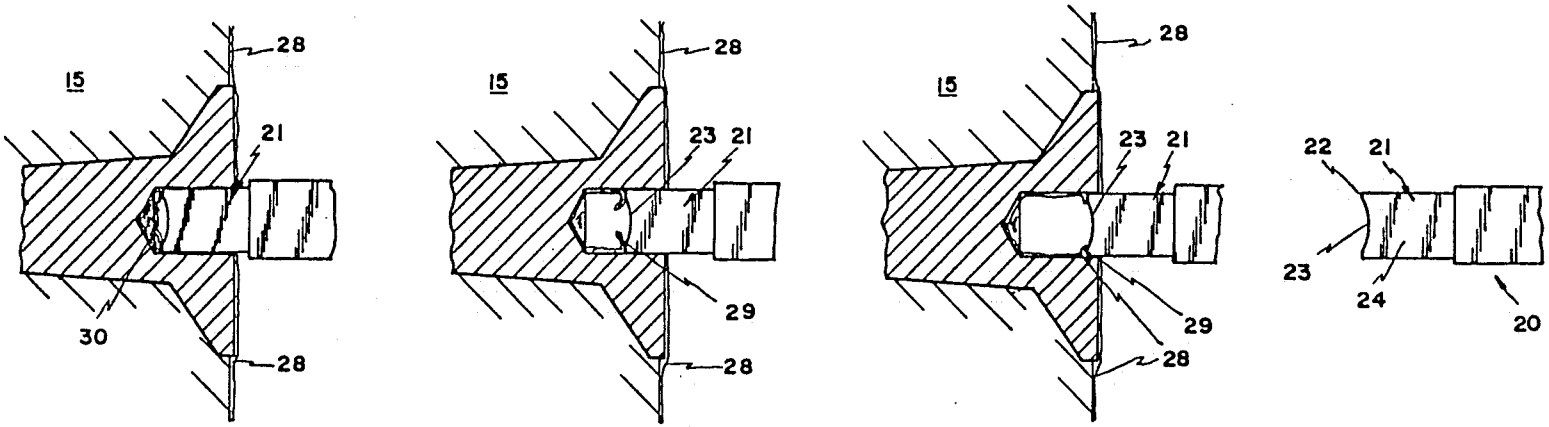
FIG. 5
FIG. 6
FIG. 7
FIG. 8
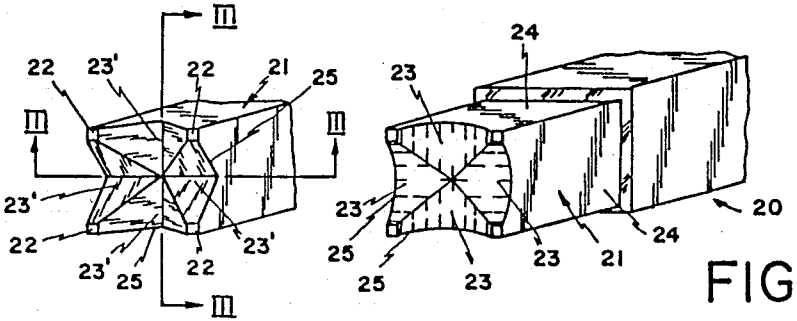
FIG. 1.
FIG. 2
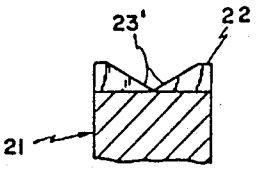
FIG. 3
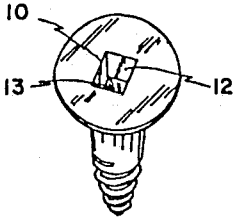
FIG. 4

SCREW DRIVER TIP

This invention relates to a screw driver tip.

There are various types of screw heads and screw drivers. Of the conventional variety there are the slot head screws with chisel type screw driver for engaging the slots; Phillips head screws with appropriate driver of different dimensions depending upon the slot size in the head of the screw; and even other types of screws and screw drivers for instance H-shape or diametrical slots with central guide spigots. The latter three types are more common outside of Canada. In fact the Phillips type head is almost universally accepted particularly in the metal fabricating industry and electronics and electrical industry as rivalling the simple slot head.

In Canada, however, the Phillips head is not popular. Instead the so-called Robinson screw and driver is more popular. The reason for this is that Robinson, having essentially a rectalinear cross section for the screw head socket, allows the screw to be set upon the tip of the driver and thus the driver can hold, through its tip which mates into the socket. Thus, the screw can be easily inserted into, for instance a vertical wall or ceiling, without the need of holding the screw separate and apart from the driver as by the use of two hands because the mating tip and socket form a temporary union which allows the driver to "hold" the screw only through the mating male and female union between tip and socket.

There is a problem of course with screws of the Phillips or Robinson or other varieties for removal of the screw particularly when the screw may have been covered with painting or other decorative material so as to have covered the socket or otherwise when the socket has accumulated debris. This is because the paint or debris tends to cover the walls of the screw socket and to congeal or coalesce to them reducing the throat or bore of a screw socket. This accumulation along the walls of the socket or bore is particularly evident for Phillips or Robinson type.

With increasing renovations being conducted to homes and to physical plant facilities it is necessary from time to time to remove the Phillips or Robinson screws from their location. When paint, which congeals to the socket recess, has been used as a decorative coating, the congealled paint in the screw socket inhibits nesting of the driver tip into the screw; thus, the screw cannot be easily removed.

We have conceived, particularly for Robinson type screw sockets, a modified screw driver tip which when inserted into the screw head scrapes the internal walls of the screw socket clean to allow proper nesting and mating of the driver tip into the recess or socket in the screw head. This allows proper mating of tip with socket hence the screw can be easily removed notwithstanding that paint or other debris has adhered to the socket walls.

The invention therefore contemplates a screw driver tip for driving a screw having a receiving bore for mating with the tip, the bore defined by walls and a base, the tip comprising a shaft of predetermined configuration having side walls which extend into a face, at one end, the face defining a recess therein: and a cutting edge between the face and each of the side walls, to thereby provide, on the one hand a mating surface between the walls and on the other hand a cutting edge that is adapted to scrape the bore walls clean during mating insertion of the tip into the bore. Preferably the face defines, with the base of the bore, a collection region between the face and base wherein materials scraped from the bore walls tend to collect.

Such screw tip is miraculous in its ability to clean out a socket while permitting total engagement of the screw tip into the socket to thereby allow the screw to easily be removed by generally one single continuous motion of inserting the screw driver tip into the socket and counter-rotating the driver.

The invention will now be explained by way of example and reference to the accompanying drawings in which:

FIG. 1 is a perspective view of a screw tip for a Robinson type socket.

FIG. 2 is an alternative perspective of the tip portion of a typical screw driver.

FIG. 3 is a section along lines III—III of FIG. 2.

FIG. 4 is a perspective of a typical Robinson socket screw.

FIG. 5 is, in elevation, the tip of FIG. 1 and FIGS. 6 through 8 respectively indicating the progressive steps of the screw tip engagement during insertion into the screw socket of FIG. 4 when that socket is contaminated with paint or other decorative coating.

Referring now to FIG. 1, the lower portion or extremity of the screw driver is generally indicated as shank 20. Its free end depends into a hardened member or tip 21. Preferably the tip is hardened steel of a Rockwell hardness of between 52 to 60 and preferably 60. The tip has four sides 24 and is configured at its end into a face of four concave (arcuate) surfaces 23 defining at each of the four corners of the face with the sides, a flat facial corner 22. Alternatively, the face could have instead of the four concave surfaces, the surfaces bevelled as 23' and illustratively indicated in FIG. 2. The depth of the recesses in the face should be in the order of at least 1/32" (2 millimeters), between the margins of the face and each side wall 24 a cutting and scraping edge 25 is formed.

In the figures a typical Robinson screw is shown with receiving socket 10 having vertical walls 12 and an inclined or concave base 13, which is more clearly seen in FIGS. 6 through 8. The base defines the bottom of the socket 10. Typically, when the screw is placed into a wall for securing a member, for instance into wall 15, it is subsequently decorated with a coat of material such as paint 28 and a substantial or the total portion of the socket 10 is coated or filled with the paint 28. The socket must be cleaned before conventional drivers can be inserted into the socket to remove the screw.

In our embodiment, the screw driver tip 21 having the profile above described, is placed as at FIG. 6 into the upper regions of the socket 10 and is slowly pushed in a continuous inserting motion into the socket. The cutting edges 25 scrape the walls 12 of the socket 10 and allow the mating of bit and the socket. As clearly seen in FIG. 7 the scraped off paint begins to accumulate into the center region of the socket and in advance of the moving face. As seen in FIG. 8, the accumulation 30. Because of the convex or bevelled profile of the tip face, in combination with a normal concave base of the socket there is normally sufficient space for the accumulation 30 to occur and to allow for but one single insertion of the tip into the socket. As such, when the screw driver is properly inserted into the socket 10, the socket walls have been cleaned and the tip nest firmly and mates in the socket. On rotation of the driver, which can occur immediately on insertion of the tip into the socket, the screw is removed without the painstaking need to clean the socket.

I claim:

1. A screw driver having a shank with a screw engaging tip for mating within a recess on the face of a screw, said recess having walls and a base:

said tip having side walls and a face for mating insertion within said recess and cutting edges on said tip defined between said side walls and said face and adapted to scrape debris from the walls of said recess during said mating insertion; said recess is substantially rectangular in configuration and said tip has four side walls and a recessed face; and said tip face comprises a recessed center extending outward in four concave arcuate surfaces to four flat facial corners with said sidewalls to define cutting edges between said corners and said side walls.

* * * * *